US006059547A

United States Patent [19]

Konishi et al.

[11] Patent Number: 6,059,547

[45] Date of Patent: May 9, 2000

[54] CYLINDER INJECTION HIGH-PRESSURE FUEL PUMP

[75] Inventors: Keiichi Konishi; Yoshihiko Onishi, both of Tokyo, Japan

[73] Assignee: Mitsubishi Denki Kabushiki Kaisha, Tokyo, Japan

[21] Appl. No.: 09/060,380

[22] Filed: Apr. 15, 1998

[30] Foreign Application Priority Data

Oct. 27, 1997 [JP] Japan ..... 9-294557

[51] Int. Cl.[7] ..... F04B 11/00

[52] U.S. Cl. ..... 417/540; 417/309; 417/311; 417/541; 417/542; 123/446; 123/450; 123/506; 138/30

[58] Field of Search ..... 417/540, 311, 417/541, 542, 309; 123/446, 450, 506; 138/30

[56] References Cited

U.S. PATENT DOCUMENTS

| | | | |
|---|---|---|---|
| 4,201,522 | 5/1980 | Toyota et al. | 417/311 |
| 4,378,774 | 4/1983 | Kato | 123/446 |
| 4,523,612 | 6/1985 | Kuklo | 138/30 |
| 4,591,321 | 5/1986 | Devaux . | |
| 4,708,116 | 11/1987 | Gaa et al. | 123/506 |
| 4,870,939 | 10/1989 | Ishikawa et al. | 123/506 |
| 5,257,606 | 11/1993 | Willman et al. | 123/447 |
| 5,318,001 | 6/1994 | Djordjievic | 123/450 |
| 5,353,754 | 10/1994 | Wissmann et al. . | |

FOREIGN PATENT DOCUMENTS

| | | |
|---|---|---|
| 7-012029 | 1/1995 | Japan . |
| 7-083134 | 3/1995 | Japan . |
| 468958 | 7/1937 | United Kingdom . |
| WO 97/08454 | 3/1997 | WIPO . |

*Primary Examiner*—Teresa Walberg
*Assistant Examiner*—L. Fastovsky
*Attorney, Agent, or Firm*—Sughrue, Mion, Zinn, Macpeak & Seas, PLLC

[57] ABSTRACT

A cylinder injection high-pressure fuel pump permits reduction in size and cost thereof and it is also capable of securely absorbing high-frequency pulsations. The cylinder injection high-pressure fuel pump (200) has: a casing (1) in which an inlet passage (2) for taking fuel in and a discharge passage (35) for discharging the fuel are formed; a cylinder (30) formed in the casing (1); a fuel pressurizing chamber (32) formed in a part of the cylinder (30); and a plunger (31) disposed in the cylinder (30) such that it may reciprocate therein. As the plunger (31) reciprocates, the fuel is taken into the fuel pressurizing chamber (32) through the inlet passage (2) and pressurized therein, then the pressurized fuel is discharged through the discharge passage (35) and forcibly fed into a fuel injector of a cylinder injection type engine. The high-pressure fuel pump (200) is equipped with: a capacity chamber (44) formed by enlarging a part of the inlet passage (2); and a sealed vessel (42) which is disposed in the capacity chamber (44), which has a gas hermetically sealed therein, and which changes the volume thereof according to a change in the pressure of the capacity chamber (44).

8 Claims, 8 Drawing Sheets

VOLUME OF GAS IN RELATION TO PRESSURE WHEN HIGH-PRESSURE FUEL PUMP IS STARTED

CHANGE ΔV IN RELATION TO PRESSURE WHEN HIGH-PRESSURE FUEL PUMP IS BEING DRIVEN (MEAN PRESSURE DEFINED AS ΔV = 0)

CYLINDER INJECTION HIGH-PRESSURE FUEL PUMP

BACKGROUND OF THE INVENTION

1. Field of the Invention

The present invention relates to a high-pressure fuel pump for a cylinder injection type engine, which high-pressure fuel pump has a pulsation absorber and, more particularly, to a high-pressure fuel pump equipped with a pulsation absorber which is provided as an integral part of the high-pressure fuel pump and which absorbs the pulsation at the low pressure end thereof.

2. Description of Related Art

A diesel engine has been widely known as an engine designed to inject fuel in the cylinders of the engine which is referred to as a cylinder injection engine or a direct injection engine. In recent years, the cylinder injection type has been proposed also for a spark ignition engine or a gasoline engine. In such a cylinder injection engine, a fuel pressure of approximately 5 MPa, for example, is necessary because the fuel is injected into a cylinder during the compression stroke of the cylinder, whereas the fuel pressure is approximately 0.3 MPa in the case of a conventional engine wherein a fuel-air mixture is produced outside a cylinder.

To obtain such a high fuel pressure, a high-pressure fuel pump is generally provided on the side of a fuel injector in addition to a low-pressure fuel-pump provided in a fuel tank. In general, the low-pressure fuel pump is driven by, for example, a motor or the like and it is driven at all times as long as the power is ON, while the high-pressure fuel pump is driven by an engine and it runs as the engine runs. The high-pressure fuel pump is provided with a pulsation absorber to absorb the pulsation that takes place in the pipe at the low pressure end so as to stabilize the discharge of the high-pressure fuel pump.

FIG. 11 is a side view illustrating a conventional high-pressure fuel pump, a part thereof being shown in a sectional view; and FIG. 12 is a system diagram of the pulsation absorber on the low pressure end. In the drawings, a high-pressure fuel pump assembly 100 has a casing 1, a cylinder 30 being provided at the bottom of the casing 1; and a plunger 31 is provided in the cylinder 30 such that it is able to reciprocate therein. The cylinder 30 and the plunger 31 constitute a fuel pressurizing chamber 32.

Formed on one side surface of the casing 1 is an inlet port 14 to which a low pressure pipe (not shown) extending from the low-pressure fuel pump is connected. An inlet passage 2 is formed between the inlet port 14 and the fuel pressurizing chamber 32; a filter 8 is provided at the boundary of the inlet port 14 and the inlet passage 2. The fuel supplied from the low-pressure fuel pump is fed into the fuel pressurizing chamber 32 through the inlet passage 2. Formed also on one side surface of the casing 1 is a discharge port 34 to which a high pressure pipe (not shown) extending to a fuel injector is connected. A discharge passage 35 is formed between the discharge port 34 and the fuel pressurizing chamber 32; the fuel which has been pressurized in the fuel pressurizing chamber 32 passes through the discharge passages 35 to be discharged outside. A resonator 36 is provided in the middle of the discharge passage 35.

The plunger 31 reciprocates in the cylinder 30; it takes fuel into the fuel pressurizing chamber 32 where it pressurizes the fuel, then discharges it outside through the discharge passage 35. The high-pressure fuel pump assembly 100 is a single-cylinder type which has the single cylinder 30. Hence, oil impact occurs at every intake or discharge operation in the inlet passage 2 and the discharge passage 35, causing the fuel to pulsate. In particular, the pulsation taking place in the inlet passage 2 causes the outflow of the high-pressure fuel pump assembly 100 to drop and also causes the low pressure pipe connected to the inlet port 14 to vibrate, producing noises.

Formed on the other side surface of the casing 1 is an approximately cylindrical recessed section 13; the outer edge of the bottom surface of the recessed section 13 is in communication with an inlet passage 2*a* coming from the inlet port 14. An inlet passage 2*b* extending to the fuel pressurizing chamber 32 is in communication with the central portion of the bottom of the recessed section 13. The inlet passage 2*a* and the inlet passage 2*b* make up the inlet passage 2. In the recessed section 13, an approximately cylindrical sleeve 15 is disposed, the outer peripheral surface thereof being sealed with an O ring 16. A support 17 forming an oil passage and a sealing member 18 for sealing the gap between a piston 20 and the sleeve 15 when the engine stops are placed between one end of the sleeve 15 and the casing 1. The support 17 has a cylindrical section 17*a* and a jaw 17*b* which extends outward in the radial direction from one end of the cylindrical section 17*a*; the cylindrical section 17*a* is in communication with the inlet passage 2*b*, and the jaw 17*b* has a through hole 17*c* through which fuel passes. An annular passage 19 is formed between the jaw 17*b* and the bottom of the recessed section 13. The sealing member 18 has a thin annular shape; it provides sealing between one end of the sleeve 15 and the support 17.

Slidably provided in the sleeve 15 is the bottomed cylindrical piston 20, the bottom thereof facing the casing 1. An extremely small gap is formed between the sleeve 15 and the sliding surface of the piston 20; the gap is filled with fuel to protect the sliding surface. The sleeve 15, the piston 20, and the support 17 make up a capacity chamber 25, which is a surrounded space. The portion of the sleeve 15, which portion juts out of the casing 1, is covered by a cup-shaped cover 21, the open end of the cover 21 being secured to the casing 1 to fix the sleeve 15 to the casing 1. Provided at a predetermined position of the cover 21 is a drain nipple 22 for returning the fuel, which has leaked out, back to a fuel tank (not shown). A spring 23 is provided in a compressed state between the bottom of the piston 20 and the cover 21. When no fuel pressure is applied, the restoring force of the spring 23 pushes the piston 20 to the right in FIG. 11 to hold it there.

In the high-pressure fuel pump having the configuration explained above, the pulsation absorber is provided somewhere in the middle of the inlet passage 2 of fuel of the high-pressure fuel pump to move the piston 20 to absorb the pulsation of the fuel according to the fluctuation in the fuel pressure. More specifically, the fuel supplied through the inlet passage 2*a* passes through the annular passage 19 and the through hole 17*c* into the capacity chamber 25, then goes to the high-pressure fuel pump through the inlet passage 2*b*. At this time, the fuel pulsates in the intake passage 2*b* due to the intake and discharge operation of the high-pressure fuel pump; when the fuel pressure is high, the piston 20 moves to the left in FIG. 11, while it moves to the right in FIG. 11 when the fuel pressure is low. Thus, the pulsation of the fuel in the inlet passage 2 is absorbed.

The cylinder injection, high-pressure fuel pump is characterized by the considerably high fuel pressure, approximately 5 MPa, and a wide range of pulsation including high-frequency pulsation. In the conventional piston-type pulsation absorber described above has poor responsiveness due to the frictional resistance between the piston 20 and the sleeve 15 and also to the dead weight of the piston 20. This has been posing a problem in that the pulsation in a high-frequency range including a surge pressure cannot be fully removed.

The conventional piston-type pulsation absorber on the low pressure end has been disadvantageous in that it is large and has many components with resultant high cost.

SUMMARY OF THE INVENTION

The present invention has been made with a view toward solving the problems mentioned above, and it is an object of the present invention to provide a cylinder injection high-pressure fuel pump which has a pulsation absorber integrally provided on a low pressure end, which permits reduced size and lower cost, and which is able to securely absorb pulsations in a high-frequency zone.

To this end, according to the present invention, there is provided a cylinder injection high-pressure fuel pump having: a casing in which an inlet passage for taking in fuel and a discharge passage for discharging fuel are formed, a cylinder formed in the casing, a fuel pressurizing chamber formed in a part of the cylinder, and a plunger disposed in the cylinder so that it may reciprocate therein; wherein the reciprocating motion of the plunger causes the fuel to be taken through the inlet passage into the fuel pressurizing chamber where it is pressurized, and the pressurized fuel is discharged through the discharge passage and forcibly fed to a fuel injector of the cylinder injection engine; the cylinder injection high-pressure fuel pump being equipped with a low-pressure-end pulsation absorber which has a capacity chamber formed by enlarging a part of the inlet passage, and a sealed vessel which is housed in the capacity chamber and which has a gas hermetically sealed therein to change the volume thereof according to a change in the pressure of the capacity chamber.

In a preferred form of the cylinder injection high-pressure fuel pump according to the present invention, at least a part of the sealed vessel is metal bellows.

In another preferred form of the cylinder injection high-pressure fuel pump according to the present invention, the gas is air of atmospheric pressure.

In yet another preferred form of the cylinder injection high-pressure fuel pump according to the present invention, the sealed vessel contains an elastic member which has an elastic force in the expanding direction of the sealed vessel with respect to the contracting direction thereof.

In a further preferred form of the cylinder injection high-pressure fuel pump according to the present invention, the capacity chamber has a recessed section formed such that it is in communication with the inlet passage, and a plate which hermetically seals the recessed section, on the outer surface of the casing.

In a further preferred form of the cylinder injection high-pressure fuel pump according to the present invention: the capacity chamber has a recessed section formed such that it is in communication with the inlet passage, and a plate which hermetically seals the recessed section, on the outer surface of the casing; the sealed vessel has the metal bellows which is composed of a bottomed cylinder with bellows formed on the cylinder section thereof, and a base member which hermetically seals an opening of the metal bellows; the base member has a flange section on the outer periphery thereof; and the metal bellows is placed in the recessed section and the sealed vessel is fixed by the flange section thereof being clamped between the casing and the plate.

DESCRIPTION OF THE PREFERRED EMBODIMENTS

First Embodiment

Figure 1:
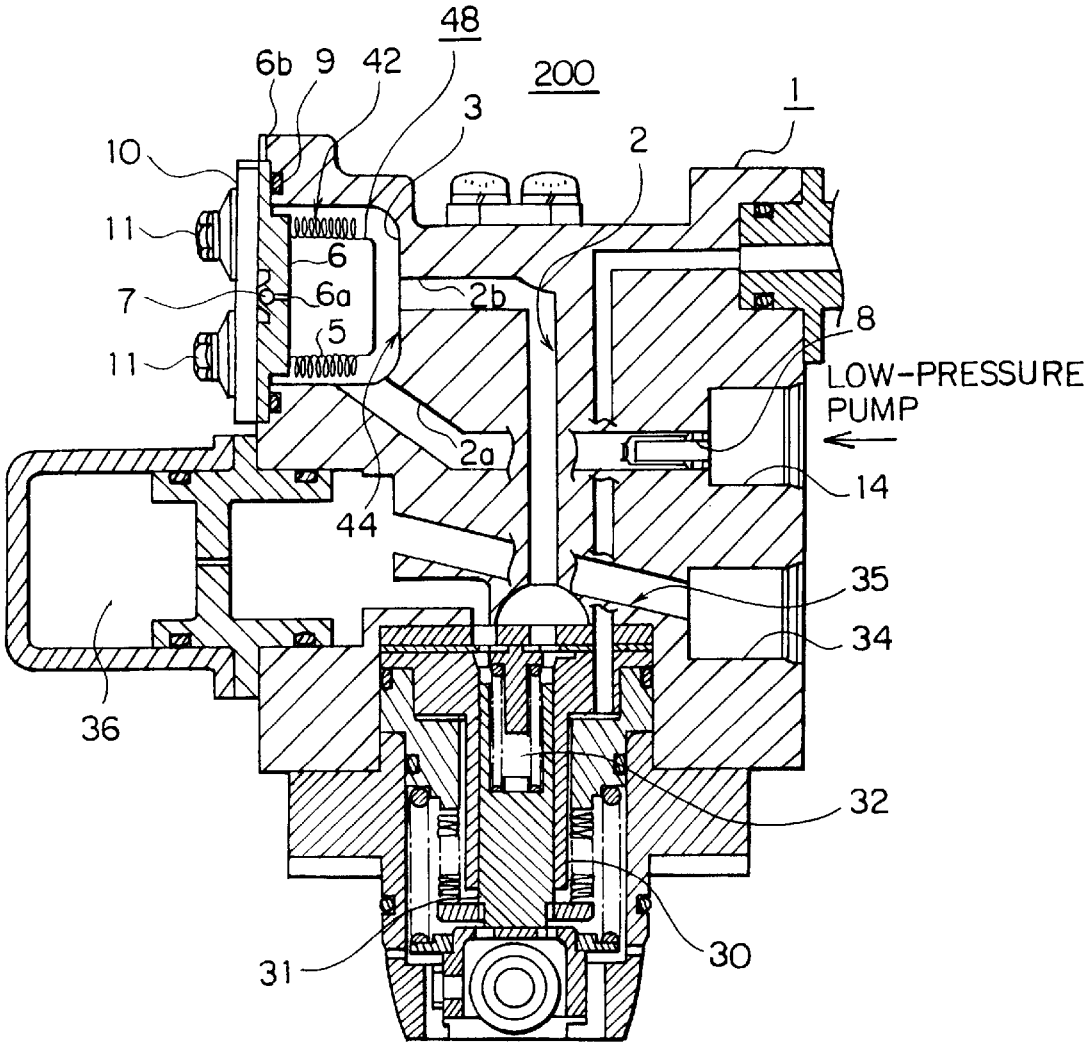
FIG. 1 is a side view illustrating a high-pressure fuel pump in accordance with the present invention, a part thereof being shown in a sectional view.
Figure 2:
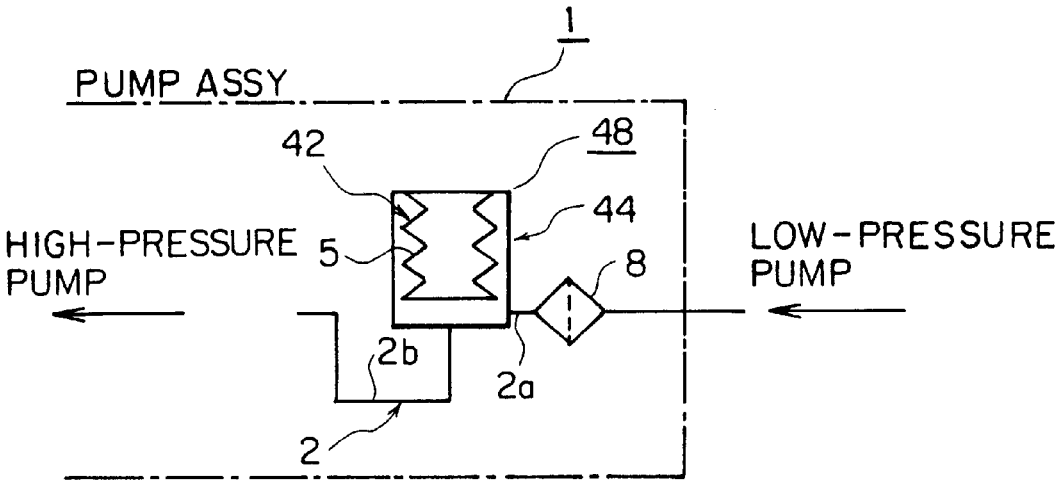
FIG. 2 is a system diagram of a pulsation absorber on a low pressure end.

FIG. 1 is a side view illustrating a high-pressure fuel pump in accordance with the present invention, a part thereof being shown in a sectional view. FIG. 2 is a system diagram of a pulsation absorber on a low pressure end. In FIG. 1 and FIG. 2, a high-pressure fuel pump 200 has a casing 1, a cylinder 30 being provided at the bottom of the casing 1; and a plunger 31 is provided in the cylinder 30 such that it is able to reciprocate therein. The cylinder 30 and the plunger 31 constitute a fuel pressurizing chamber 32 which pressurizes fuel.

Formed on one side surface of the casing 1 is an inlet port 14 to which a low pressure pipe (not shown) extending from the low-pressure fuel pump is connected. An inlet passage 2 is formed between the inlet port 14 and the fuel pressurizing chamber 32; a filter 8 is provided at the boundary of the inlet port 14 and the inlet passage 2. The fuel supplied from the low-pressure fuel pump is fed into the fuel pressurizing chamber 32 through the inlet passage 2. Formed also on one side surface of the casing 1 is a discharge port 34 to which a high pressure pipe (not shown) extending to a fuel injector is connected. A discharge passage 35 is formed between the discharge port 34 and the fuel pressurizing chamber 32; the fuel which has been pressurized in the fuel pressurizing chamber 32 passes through the discharge passages 35 to be discharged outside. A resonator 36 is provided in the middle of the discharge passage 35.

The plunger 31 reciprocates in the cylinder 30, it takes fuel into the fuel pressurizing chamber 32 where it pressurizes the fuel, then discharges it outside through the discharge passage 35. The high-pressure fuel pump 200 is a single-cylinder type which has the single cylinder 30. Hence, oil impact occurs at every intake or discharge operation in the inlet passage 2 and the discharge passage 35, causing the fuel to pulsate. In particular, the pulsation taking place in the inlet passage 2 causes the outflow of the high-pressure fuel pump 200 to drop and also causes the low pressure pipe connected to the inlet port 14 to vibrate, producing noises.

Formed on one side surface of the casing 1 is an approximately cylindrical recessed section 3; an inlet passage 2*a* coming from the inlet port 14 is in communication with the recessed section 3 at a predetermined position of the inner surface of the recessed section 3. An inlet passage 2*b* extending to the high-pressure fuel pump is in communication with the central portion of the bottom of the recessed section 3. The inlet passage 2*a* and the inlet passage 2*b* make up the inlet passage 2. Contained in the recessed section 3 is a sealed vessel 42 which changes the volume thereof according to the change in pressure. The sealed vessel 42 is comprised of bottomed cylindrical metal bellows 5 which is made of stainless steel and the cylindrical section of which is made of bellows; and an approximately disc-shaped base member 6 which hermetically seals the opening of the metal bellows 5 and which is also made of stainless steel. The opening of the metal bellows 5 is secured by welding to the main surface of the base member 6. Sealed inside the sealed vessel 42 is air of atmospheric pressure. The base member 6 has an adjusting hole 6*a* for adjusting the volume of the air inside; the adjusting hole 6*a* is closed by a steel ball 7.

Figure 3:
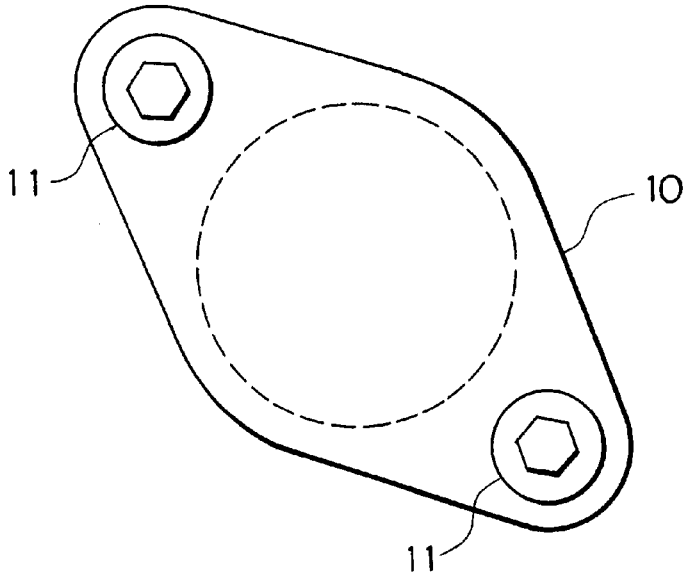
FIG. 3 is a front view of a plate.

A flange section 6*b* is formed fully around the outer periphery of the base member 6. The base member 6 is sealed with an O ring 9 with the flange section 6*a* held against the area around the opening of the recessed section 3. A flat plate 10 is provided at a place further outward of the base member 6. The plate 10 is shaped like a narrow long flat plate as shown in FIG. 3; it is fastened with two bolts 11 to the casing 1 with the flange section of the base member 6 clamped therebetween, thus fixing the sealed vessel 42 in the recessed section 3. The plate 10 covers the recessed section 3 to make the hermetically sealed capacity chamber 44. Th capacity chamber 44 is provided in the inlet passage 2 through which fuel passes; it is formed such that a part of the inlet passage 2 is enlarged. When the pressure in the capacity chamber 44 changes, the sealed vessel 42 changes the volume thereof according to the change. The sealed vessel 42 and the capacity chamber 44 constitute a pulsation absorber 48 on the low pressure end. The pulsation absorber 48 on the low pressure end is provided in the inlet passage 2 of fuel of the high-pressure fuel pump; it expands or contracts the metal bellows 5 in response to a change in the fuel pressure so as to absorb the fuel pulsation caused by the intake or discharge operation of the high-pressure fuel pump.

Figure 4:
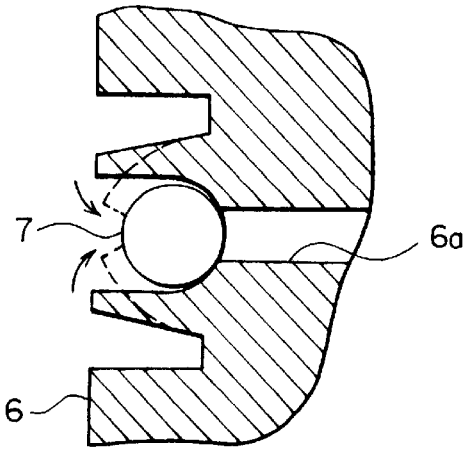
FIG. 4 is a partial sectional view of a base member, illustrating how an adjustment hole is closed.

As set forth above, the bottomed cylindrical metal bellows 5 of the sealed vessel 42 is fabricated by hermetically welding the opening thereof to the main surface of the base member 6; the volume of the air inside inevitably changes when forming or welding the metal bellows 5; therefore, the adjusting hole 6*a* is formed in the base member 6 beforehand. After the metal bellows 5 has been welded, the adjusting hole is closed by the steel ball 7 at the end (see FIG. 4).

Thus, since the cylinder injection high-pressure fuel pump has the capacity chamber 44 and the sealed vessel 42, it eliminates the need for a drain nipple or the like for sending leaked fuel back into the fuel tank; moreover, the simpler structure thereof permits a reduction in the number of components with resultant lower cost. In addition, the absence of sliding portions leads to higher durability because of the absence of wearing parts.

The metal bellows 5 has better responsiveness than a conventional piston, so that it is able to securely absorb the pulsations in a high-frequency band.

The use of the atmospheric-pressure air for the gas sealed in the metal bellows 5 permits easier manufacture at lower cost.

Furthermore, the capacity chamber 44 is comprised of the recessed section 3 formed on the outer surface of the casing 1 such that it is in communication with the inlet passage 2, and the plate 10 hermetically covering the recessed section 3. This also enables easier manufacture at lower cost.

The capacity chamber 44 of this embodiment is composed of the recessed section 3 formed on the outer surface of the casing 1 such that it is in communication with the inlet passage 2, and the plate 10 hermetically covering the recessed section 3; however, the configuration of the capacity chamber 44 is not limited thereto; it may have other configuration as long as it is composed of a space having a predetermined volume.

The capacity chamber 44 is communicated with the inlet passage 2 by the inlet passage 2*a* and the inlet passage 2*b* in communication with the capacity chamber 44 in this embodiment; however, as an alternative, one passage branched from the inlet passage 2 may be in communication with the 44.

The unit components of the sealed vessel 42 are not limited to the metal bellows 5 and the base member 6. The sealed vessel may take other composition as long as it is housed in the capacity chamber 44 and capable of changing the volume thereof in accordance with a change in the pressure of the capacity chamber 44. The sealed vessel may be composed of, for example, a ball or the like which has a gas sealed inside, which is made of a thin metal or the like, and which expands and contracts. It should be noted that the material must be impermeable to fuel; rubber or other similar materials are permeable to fuel.

Second Embodiment

Figure 5:
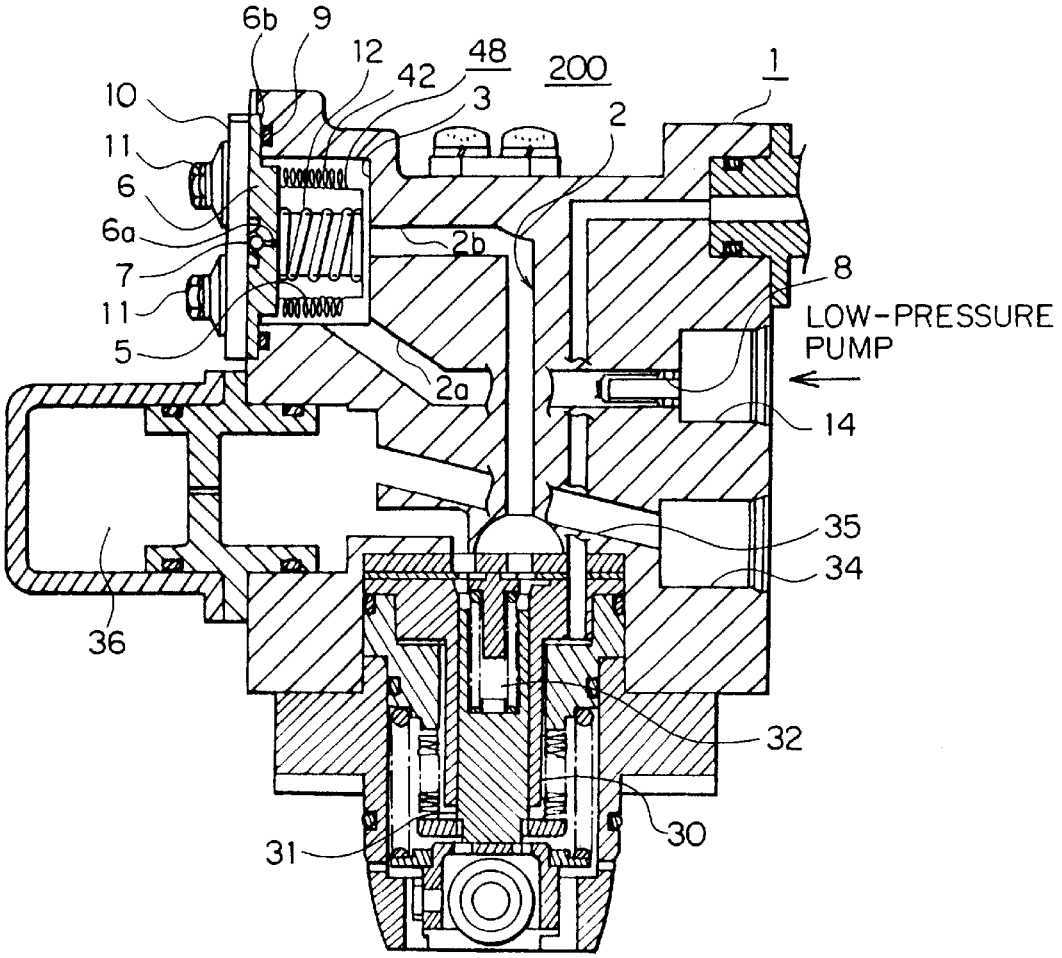
FIG. 5 is a side view illustrating another high-pressure fuel pump in accordance with the present invention, a part thereof being shown in a sectional view.
Figure 6:
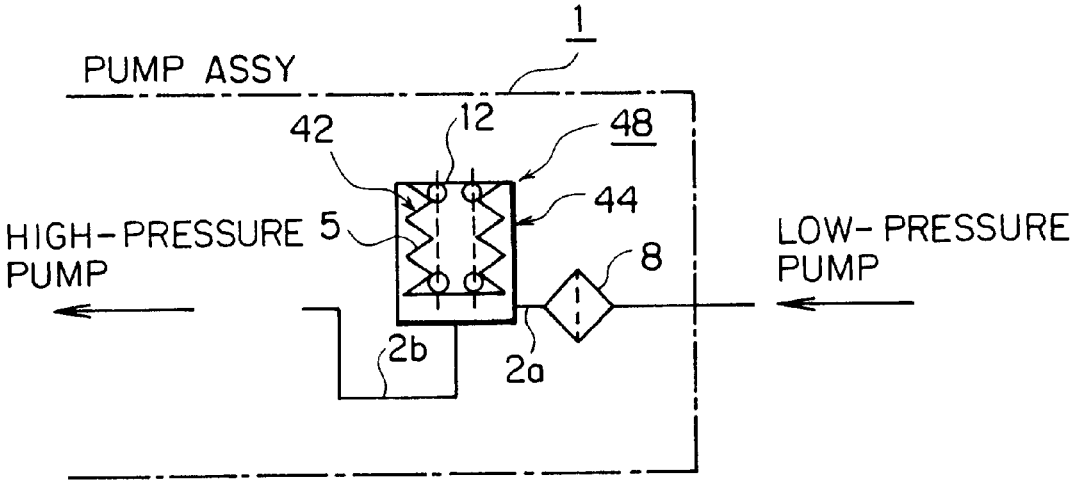
FIG. 6 is a system diagram of a pulsation absorber on a low pressure end.

FIG. 5 is a side view illustrating another high-pressure fuel pump in accordance with the present invention, a part thereof being shown in a sectional view; and FIG. 6 is a system diagram of a pulsation absorber on a low pressure end. In the second embodiment, a spring 12, which is an elastic member, is placed in the metal bellows 5; the spring 12 urges the metal bellows 5 in the direction of expansion by the restoring force thereof when the metal bellows 5 contracts. The rest of the configuration of the second embodiment is identical to the configuration of the first embodiment.

Figure 7:
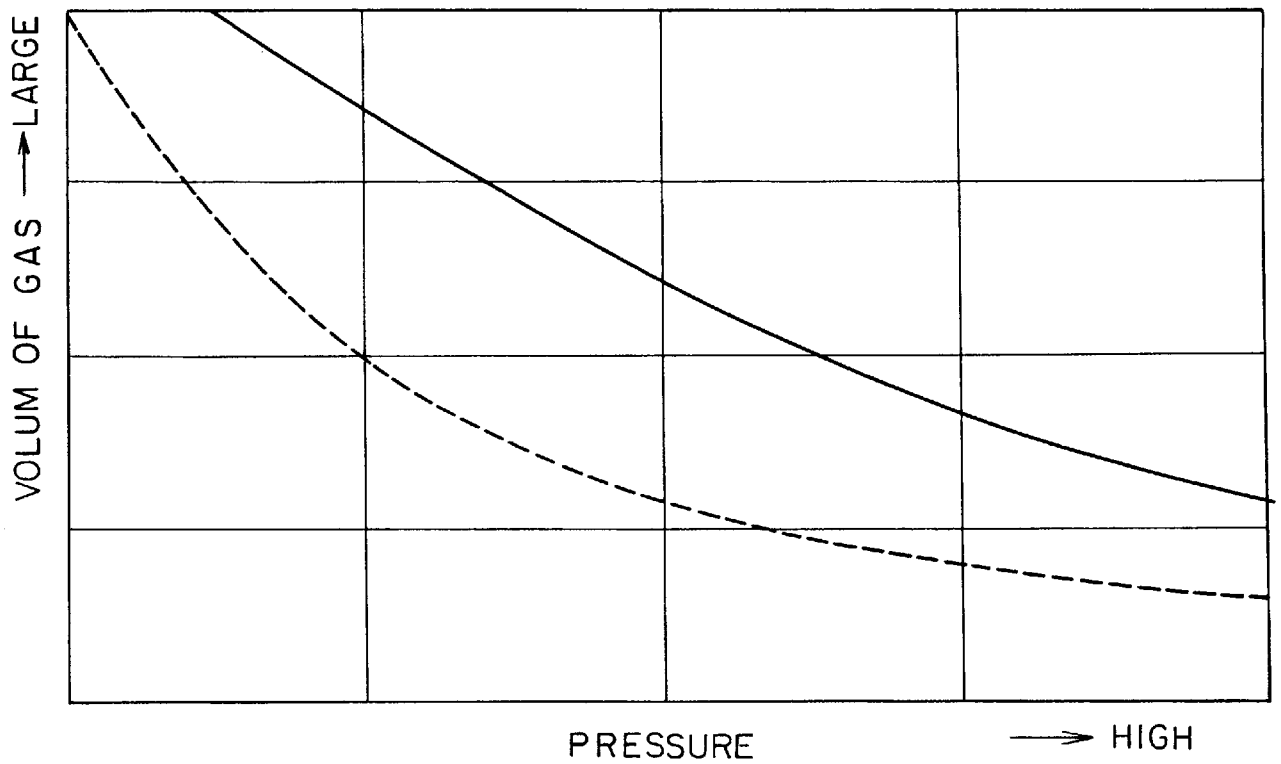
FIG. 7 is a graph showing the gas volume of a sealed vessel in relation to the pressure in the case of isothermal changes.

FIG. 7 is a graph showing the gas volume of a sealed vessel in relation to the pressure in the case of isothermal changes. The axis of ordinate indicates the gas volume, the volume value increasing upward in FIG. 7; the axis of abscissa indicates the pressure applied to the sealed vessel, the pressure value increasing toward the right in FIG. 7. The solid line indicates the changes observed in the low-pressure end pulsation absorber of this embodiment, while the dashed line indicates the changes observed in one without the spring, a set pressure value or the mean pressure value of the fuel being approximately at the center in FIG. 7. The isothermal change refers to the change in which the amount of oil is adjusted over a relatively long time; it corresponds to the change in volume at the time of starting an engine in this embodiment. In the case of this embodiment indicated by the solid line, in the vicinity of the set pressure at the center in FIG. 7, the gradient of the volume change in relation to pressure is larger than that in the one with no spring because the spring force urges the metal bellows 5 in the expanding direction. In other words, the change in pressure that takes place in response to a change in volume is smaller.

In general, the performance of the pulsation absorber is considered better as the change in pressure that takes place when the pulsation absorber changes the volume thereof in relation to a change in volume that takes place per stroke of a pump, which is an origin of the pulsation, is smaller. This means that the pulsation absorber equipped with the spring has better performance.

Figure 8:
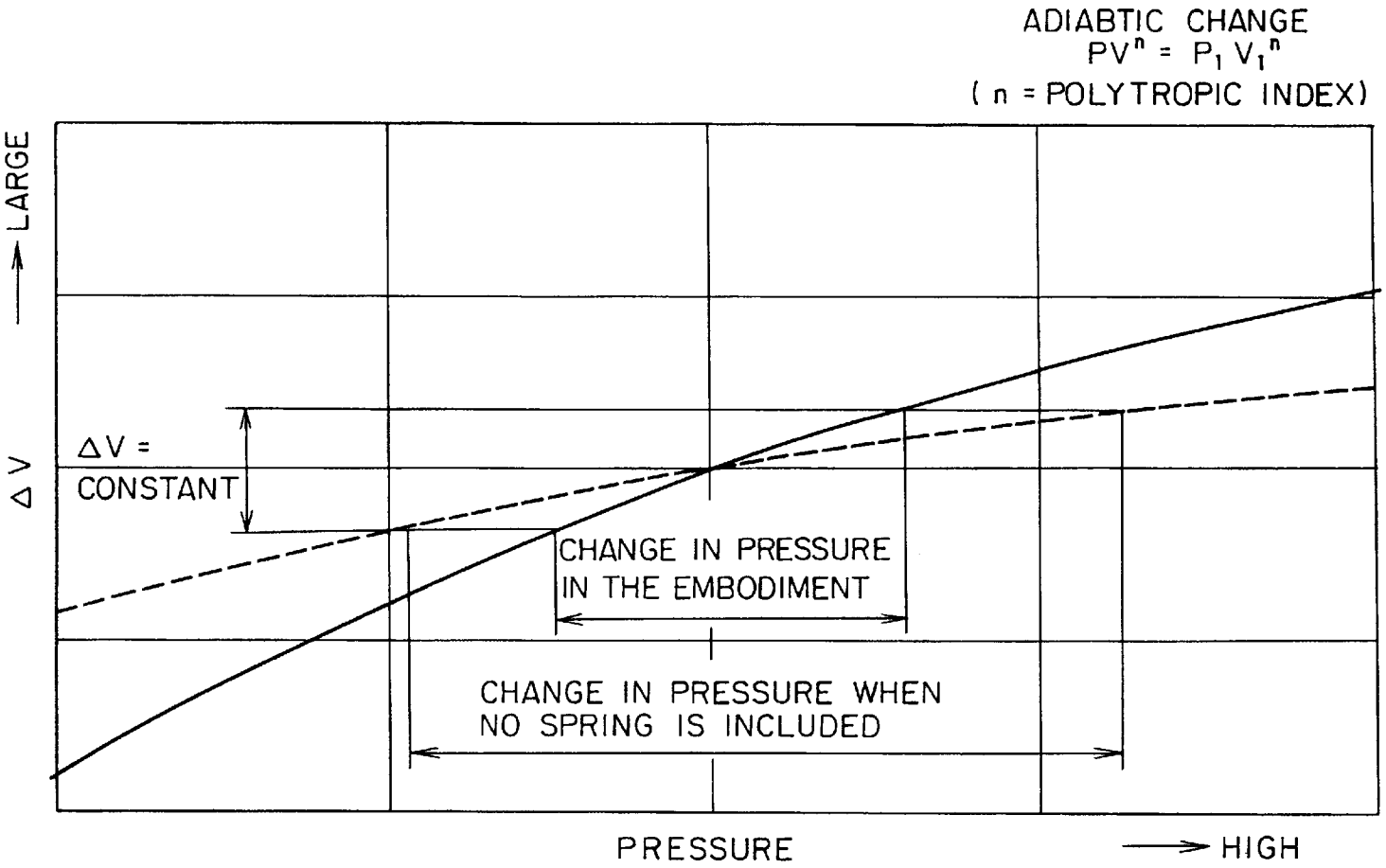
FIG. 8 is a graph showing the changes in volume in relation to pressure in the case of adiabatic changes.

FIG. 8 is a graph showing the change in volume in relation to pressure in the case of adiabatic change; it corresponds to the change in volume observed when the engine is being driven. The axis of ordinate indicates the change in capacity, while the axis of abscissa indicates the change in volume. The mean volume value under a mean pressure is at the center; the values above it indicate positive changes from the mean volume, while the values below it indicate negative changes from the mean volume. The solid line indicates the changes observed in this embodiment, while the dashed line indicates the changes observed in the pulsation absorber without the spring.

The change in volume that takes place per stroke of the high-pressure pump, which is the origin of pulsation is constant; when the change in volume is fixed, the change in pressure observed in this embodiment is smaller than that observed in the one without the spring. This means that the performance of the pulsation absorber of this embodiment is better.

Figure 9:
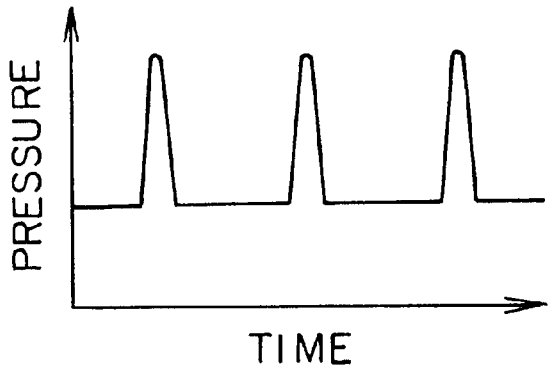
FIG. 9 shows an example of a pulsation having quick rise and fall.
Figure 10:
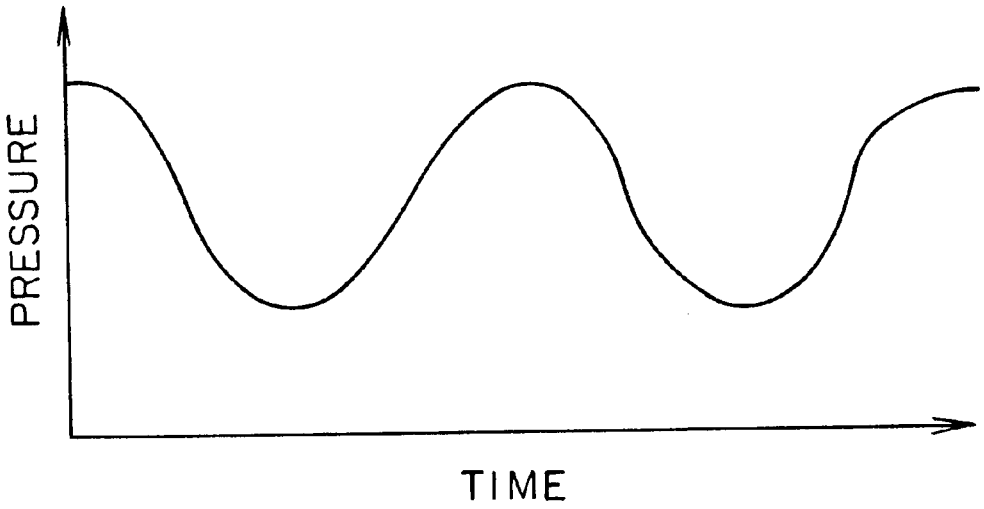
FIG. 10 is an example of a pulsation which exhibits a large pulsation width at low frequencies.
Figure 11:
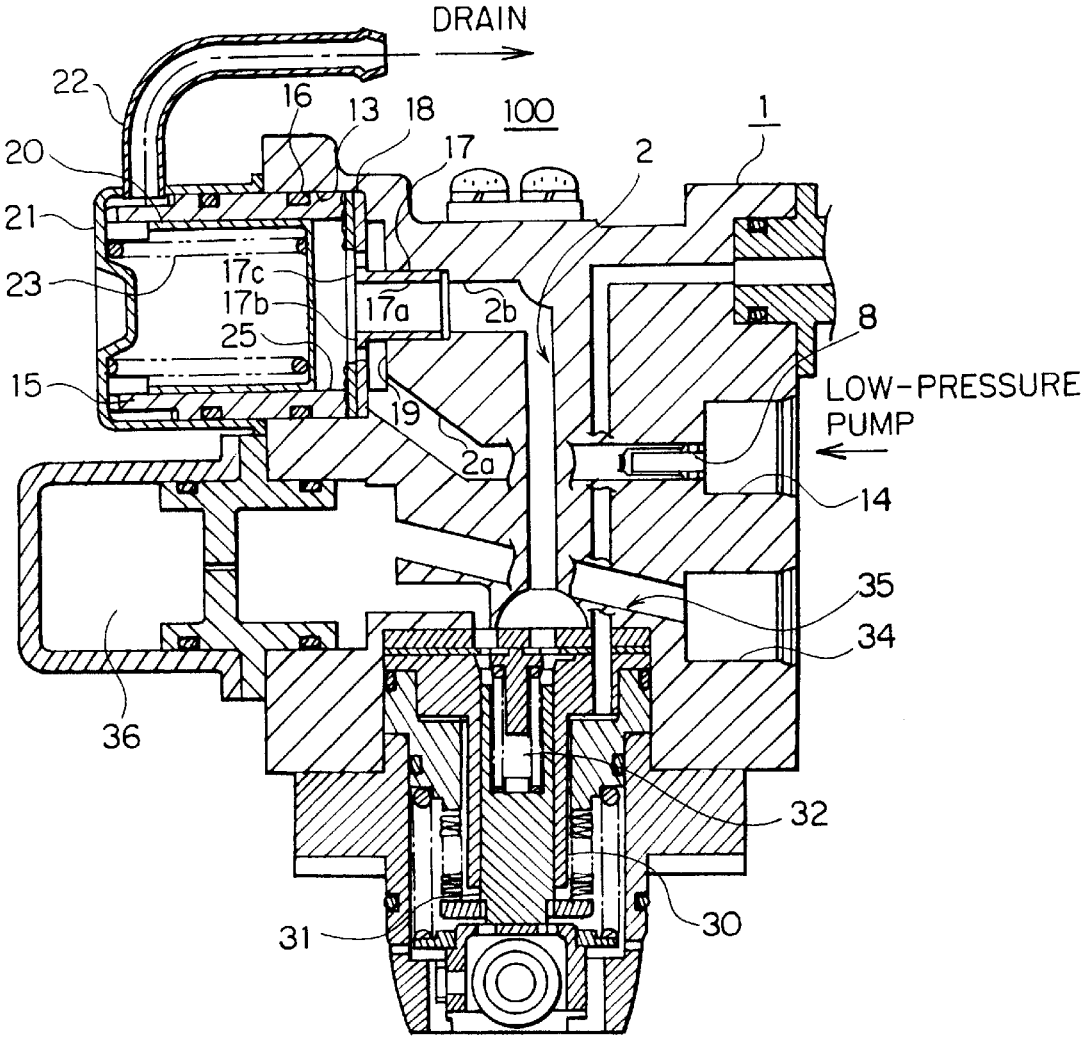
FIG. 11 PRIOR ART
FIG. 11 is a side view illustrating a conventional high-pressure fuel pump, a part thereof being shown in a sectional view.
Figure 12:
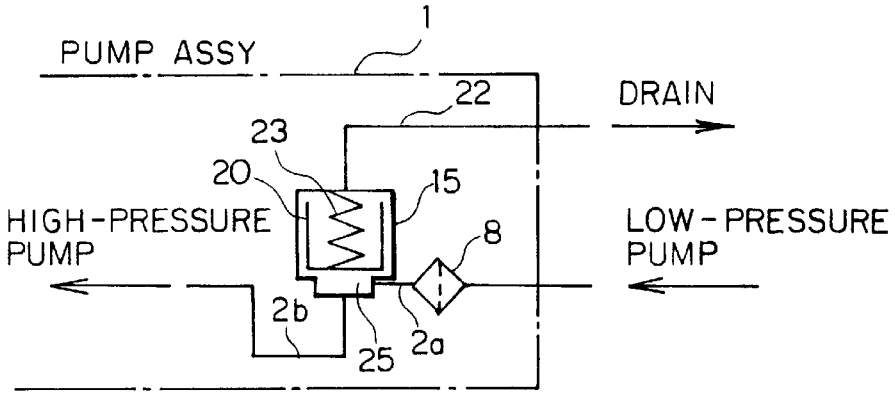
FIG. 12 PRIOR ART
FIG. 12 is a system diagram of a pulsation absorber on a low pressure end.

Absorbing the pulsation such as a surge pressure, shown in FIG. 9, which rises momentarily and disappears immediately requires only the responsiveness of the pulsation absorber, the required volume being small; however, absorbing a sinusoidal pulsation generated at low frequencies as shown in FIG. 10 requires that the pulsation absorber provide a certain capacity, i.e. absorption and discharge amount.

The metal bellows in this embodiment has the spring, which is an elastic member; hence, it provides a sufficient gas volume even when a preset pressure is applied. In addition, the pulsation absorber of the embodiment absorbs and discharges a large amount of oil in the case of adiabatic change, so that it is capable of also securely absorbing low-frequency pulsations of large pulsation widths.

Thus, the cylinder injection high-pressure fuel pump in accordance with the present invention has a casing in which an inlet passage for taking in fuel and a discharge passage for discharging fuel are formed, a cylinder formed in the casing, a fuel pressuring chamber formed in a part of the cylinder, and a plunger disposed in the cylinder so that it may reciprocate therein; wherein the reciprocating motion of the plunger causes the fuel to be taken through the inlet passage into the fuel pressurizing chamber where it is pressurized, and the pressurized fuel is discharged through the discharge passage and forcibly fed to a fuel injector of the cylinder injection engine; the cylinder injection high-pressure fuel pump incorporating a low-pressure-end pulsation absorber which has a capacity chamber formed by enlarging a part of the inlet passage, and a sealed vessel which is housed in the capacity chamber and which has a gas hermetically sealed therein to change the volume thereof according to a change in the pressure of the capacity chamber. Hence, the number of components can be reduced, permitting reduced cost. Further, the elimination of sliding components leads to higher durability because of the absence of wearing parts.

In the cylinder injection high-pressure fuel pump in accordance with the present invention, at least a part of the sealed vessel is a metal bellow. This ensures good responsiveness, making it possible to securely absorb high-frequency pulsations.

In the cylinder injection high-pressure fuel pump in accordance with the present invention, the gas is air of atmospheric pressure. This permits easier fabrication at lower cost.

In the cylinder injection high-pressure fuel pump in accordance with the present invention, the sealed vessel contains an elastic member which has an elastic force in the expanding direction of the sealed vessel with respect to the contracting direction thereof. Hence, a sufficient gas volume is provided when a preset pressure is applied, so that the change in volume in relation to pressure can be increased, making it possible to securely absorb low-frequency pulsations of large pulsation widths.

In the cylinder injection high-pressure fuel pump in accordance with the present invention, the capacity chamber has a recessed section formed such that it is in communication with the inlet passage, and a plate which hermetically seals the recessed section, on the outer surface of the casing. This permits easier fabrication at lower cost.

In a further preferred form of the cylinder injection high-pressure fuel pump: the capacity chamber has a recessed section formed such that it is in communication with the inlet passage, and a plate which hermetically seals the recessed section, on the outer surface of the casing; the sealed vessel has the metal bellows which is composed of a bottomed cylinder with bellows formed on the cylinder section thereof, and a base member which hermetically seals an opening of the metal bellows; the base member has a flange section on the outer periphery thereof; and the metal bellows is placed in the recessed section and the sealed vessel is fixed by the flange section thereof being clamped between the casing and the plate. Hence, the capacity chamber can be formed using a simple structure, thus permitting the sealed vessel to be secured in the capacity chamber by a simple structure.

What is claimed is:

1. A cylinder injection high-pressure fuel pump having: a casing in which an inlet passage for taking in fuel and a discharge passage for discharging fuel are formed, a cylinder formed in said casing, a fuel pressurizing chamber formed in a part of said cylinder, and a plunger disposed in said cylinder so that it may reciprocate therein; wherein the reciprocating motion of said plunger causes the fuel to be taken through said inlet passage into said fuel pressurizing chamber where it is pressurized, and the pressurized fuel is discharged through said discharge passage and forcibly fed to a fuel injector of a cylinder injection engine;

said cylinder injection high-pressure fuel pump comprising a low-pressure-end pulsation absorber which has a capacity chamber formed by enlarging a part of said inlet passage, and a sealed vessel which is housed in said capacity chamber and which has a gas hermetically sealed in said sealed vessel to change a volume of said sealed vessel according to a change in a pressure of said capacity chamber.

2. A cylinder injection high-pressure fuel pump according to claim 1, wherein at least a part of said sealed vessel is a metal bellows.

3. A cylinder injection high-pressure fuel pump according to claim 1, wherein said gas is air of atmospheric pressure.

4. A cylinder injection high-pressure fuel pump according to claim 1, wherein said sealed vessel contains an elastic member which has an elastic force in an expanding direction of said sealed vessel with respect to a contracting direction of said scaled vessel.

5. A cylinder injection high-pressure fuel pump according to claim 1, wherein said capacity chamber has a recessed section formed such that said recessed section is in communication with said inlet passage, and a plate which hermetically seals said recessed section, on an outer surface of said casing.

6. A cylinder injection high-pressure fuel pump according to claim 2, wherein:

said capacity chamber has a recessed section formed such that said recessed section is in communication with said inlet passage, and a plate which hermetically seals said recessed section, on an outer surface of said casing;

said sealed vessel has said metal bellows which is composed of a bottomed cylinder with bellows formed on a cylinder section of said metal bellows, and a base member which hermetically seals an opening of said metal bellows;

said base member has a flange section on an outer periphery thereof; and said metal bellows is placed in said recessed section and said sealed vessel is fixed by said flange section by clamping a portion of said base member between said casing and said plate.

7. The cylinder injection high-pressure fuel pump according to claim 1, wherein at least a part of said sealed vessel is a bellows.

8. The cylinder injection high-pressure fuel pump according to claim 1, wherein said sealed vessel changes volume without frictionally engaging, under dynamic friction, interior walls of said capacity chamber.

* * * * *